US010650960B2

(12) United States Patent
Yoshida et al.

(10) Patent No.: US 10,650,960 B2
(45) Date of Patent: May 12, 2020

(54) REACTOR HAVING END PLATE AND PEDESTAL

(71) Applicant: FANUC CORPORATION, Yamanashi (JP)

(72) Inventors: Tomokazu Yoshida, Yamanashi (JP); Masatomo Shirouzu, Yamanashi (JP); Kenichi Tsukada, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 118 days.

(21) Appl. No.: 16/038,200

(22) Filed: Jul. 18, 2018

(65) Prior Publication Data

US 2019/0035539 A1 Jan. 31, 2019

(30) Foreign Application Priority Data

Jul. 25, 2017 (JP) ..... 2017-143575

(51) Int. Cl.

| | |
|---|---|
| ***H01F 27/33*** | (2006.01) |
| ***H01F 27/28*** | (2006.01) |
| ***H01F 27/245*** | (2006.01) |
| ***H01F 3/14*** | (2006.01) |
| *H01F 37/00* | (2006.01) |

(52) U.S. Cl.

CPC ..... *H01F 27/33* (2013.01); *H01F 3/14* (2013.01); *H01F 27/245* (2013.01); *H01F 27/28* (2013.01); *H01F 37/00* (2013.01)

(58) Field of Classification Search

CPC ..... H01F 27/00–36

USPC ..... 336/65, 83, 90, 96, 210–215, 233–234

See application file for complete search history.

(56) References Cited

U.S. PATENT DOCUMENTS

| | | | | |
|---|---|---|---|---|
| 2,350,029 | A * | 5/1944 | Glass, Jr. | H01F 27/245 336/178 |
| 5,596,305 | A * | 1/1997 | Puri | H01F 27/327 336/205 |
| 7,084,731 | B2 * | 8/2006 | Kubo | G03F 7/70716 310/414 |
| 7,768,373 | B2 | 8/2010 | Shudarek | |
| 2012/0106210 | A1 | 5/2012 | Xu et al. | |
| 2017/0154718 | A1 | 6/2017 | Maeda et al. | |

FOREIGN PATENT DOCUMENTS

| | | | |
|---|---|---|---|
| CN | 103532263 | A | 1/2014 |
| CN | 104471657 | A | 3/2015 |
| CN | 106816279 | A | 6/2017 |
| JP | S49-43123 | A | 4/1974 |
| JP | S59-2121 | U | 1/1984 |
| JP | 2000-77242 | A | 3/2000 |

(Continued)

*Primary Examiner* — Tuyen T Nguyen

(74) *Attorney, Agent, or Firm* — Hauptman Ham, LLP

(57) ABSTRACT

A reactor includes a core body having at least three iron cores composed of a plurality of stacked magnetic plates and an end plate and a pedestal which are connected to the core body so as to interpose the core body therebetween. Gaps are formed between the at least three iron cores, through which magnetic connection can be established. An unevenness absorbing member is arranged at least one of a region between an end plate and the core body and a region between the core body and a pedestal, for absorbing unevenness in heights of the at least three iron cores in the axial direction of the core body.

12 Claims, 7 Drawing Sheets

(56) References Cited

FOREIGN PATENT DOCUMENTS

| | | | |
|---|---|---|---|
| JP | 2004-319679 | A | 11/2004 |
| JP | 2008-210998 | A | 9/2008 |
| JP | 2010-27692 | A | 2/2010 |
| JP | 2015-142095 | A | 8/2015 |
| JP | 2016-66752 | A | 4/2016 |
| WO | 2014/073252 | A1 | 5/2014 |

* cited by examiner

REACTOR HAVING END PLATE AND PEDESTAL

RELATED APPLICATIONS

The present application claims priority of Japanese Application Number 2017-143575, filed Jul. 25, 2017, the disclosure of which is hereby incorporated by reference herein in its entirety.

BACKGROUND OF THE INVENTION

1. Field of the Invention

The present invention relates to a reactor having an end plate and a pedestal.

2. Description of Related Art

Reactors include a plurality of iron core coils, and each iron core coil includes an iron core and a coil wound onto the iron core. Predetermined gaps are formed between the plurality of iron cores. Refer to, for example, Japanese Unexamined Patent Publication (Kokai) No. 2000-77242 and Japanese Unexamined Patent Publication (Kokai) No. 2008-210998. Furthermore, there are also reactors in which a plurality of iron core coils are arranged inside an annular outer peripheral iron core.

SUMMARY OF THE INVENTION

The iron cores are formed by stacking a plurality of magnetic plates, for example, iron plates, carbon steel plates, electromagnetic steel plates. The core body is formed by arranging the plurality of iron cores. However, the thicknesses of the magnetic plates may not be uniform. In such a case, there is unevenness in the heights of the iron cores. In such a state, when the core body is arranged between a pedestal and an end plate to form a reactor, a clearance is formed between the core body and the pedestal and/or between the core body and the end plate. Thus, when the reactor is energized, since such a clearance is present, there is a problem in that noise and vibration are generated by the magnetic plates due to magnetostriction.

Thus, a reactor in which unevenness in the heights of the iron cores is absorbed whereby noise and vibration are suppressed is desired.

According to a first aspect, there is provided a reactor comprising a core body including at least three iron cores composed of a plurality of stacked magnetic plates, wherein gaps are formed between one of the at least three iron cores and another iron core adjacent thereto, through which gaps the iron cores are magnetically connectable, the reactor further comprising an end plate and a pedestal which are coupled to the core body so as to interpose the core body therebetween, and an unevenness absorbing member arranged at least one of a region between the end plate and the core body and a region between the core body and the pedestal, for absorbing unevenness in heights of the at least three iron cores in an axial direction of the core body.

In the first aspect, since an unevenness absorbing member is arranged, unevenness in the heights of the iron cores can be absorbed. Thus, clearances between the end plate and the core body and between the core body and the pedestal can be eliminated, whereby, at the time of energization, noise and vibration caused by magnetostriction can be suppressed.

The object, features, and advantages of the present invention, as well as other objects, features and advantages, will be further clarified by the detailed description of the representative embodiments of the present invention shown in the accompanying drawings.

DETAILED DESCRIPTION

Figure 1A:
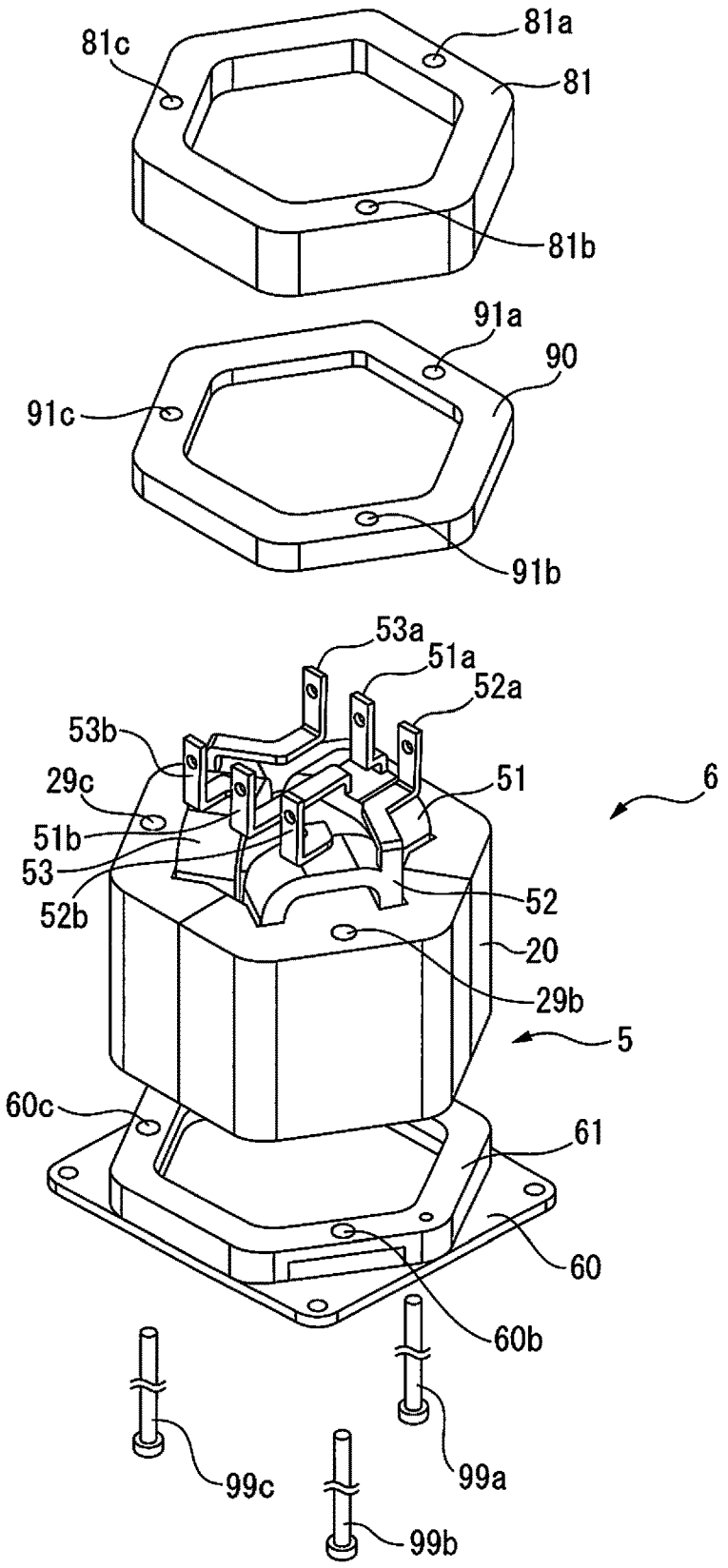
FIG. 1A is an exploded perspective view of a reactor according to a first embodiment.

The embodiments of the present invention will be described below with reference to the accompanying drawings. In the following drawings, the same components are given the same reference numerals. For ease of understanding, the scales of the drawings have been appropriately modified.

In the following description, a three-phase reactor will mainly be described as an example. However, the present disclosure is not limited in application to a three-phase reactor but can be broadly applied to any multiphase reactor requiring constant inductance in each phase. Further, the reactor according to the present disclosure is not limited to those provided on the primary side or secondary side of the inverters of industrial robots or machine tools but can be applied to various machines.

Figure 1B:
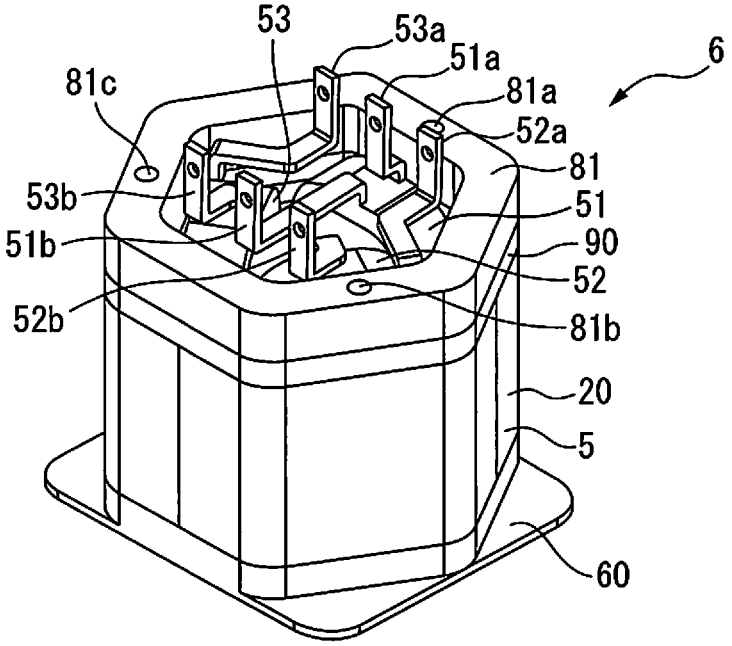
FIG. 1B is a perspective view of the reactor shown in FIG. 1A.

FIG. 1A is an exploded perspective view of a reactor according to a first embodiment and FIG. 1B is a perspective view of the reactor shown in FIG. 1A. The reactor 6 shown in FIG. 1A and FIG. 1B mainly includes a core body 5, and an annular end plate 81 and a pedestal 60 for interposing and fastening the core body 5 therebetween in the axial direction. The end plate 81 and the pedestal 60 contact the outer peripheral iron core 20, which is described later, of the core body 5 over the entire edge of the outer peripheral iron core 20.

The end plate 81 and the pedestal 60 are preferably formed from a non-magnetic material, such as aluminum, SUS, a resin material, or the like. An annular projecting part 61 having an outer shape corresponding to the end surface of the core body 5 is provided on the pedestal 60. Through-holes 60*a* to 60*c*, which penetrate the pedestal 60, are formed in the projecting part 61 at equal intervals in the circumferential direction. The end plate 81 has the same outer shape, and through-holes 81*a* to 81*c* are also formed in the end plate 81 at equal intervals in the circumferential direction. The heights of the projecting part 61 of the pedestal 60 and the end plate 81 are slightly greater than the protruding height of the coils 51 to 53 protruding from the end of the core body 5.

Figure 2:
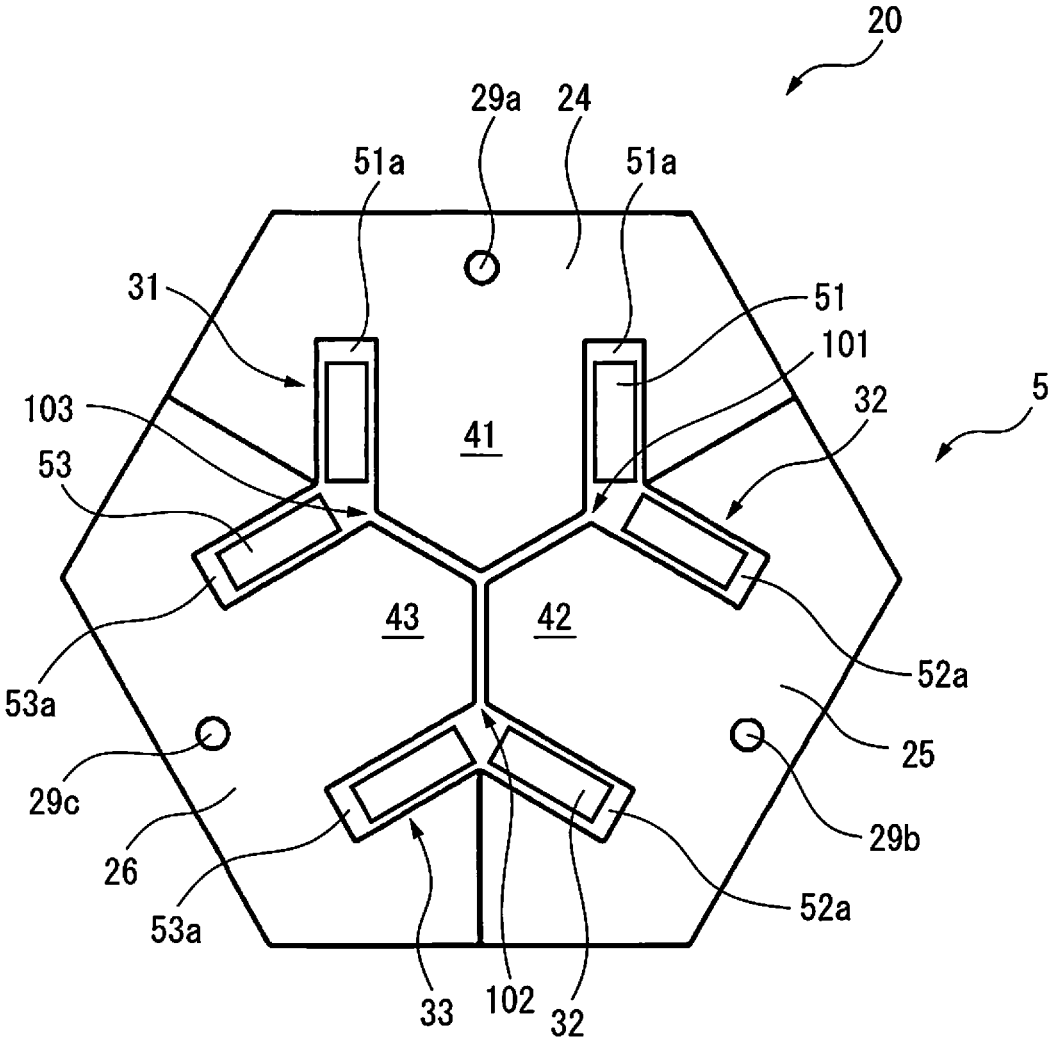
FIG. 2 is a cross-sectional view of the core body of the reactor according to the first embodiment.

FIG. 2 is a cross-sectional view of the core body of the reactor according to the first embodiment. As shown in FIG. 2, the core body 5 includes an outer peripheral iron core 20 and iron core coils 31 to 33 which are magnetically coupled to the outer peripheral iron core 20. In FIG. 2, the three iron core coils 31 to 33 are arranged inside the substantially hexagonal outer peripheral iron core 20. These iron core coils 31 to 33 are arranged at equal intervals in the circumferential direction of the core body 5.

Note that the outer peripheral iron core 20 may have other rotationally symmetrical shapes, such as a round shape. In such a case, the end plate 81 and the pedestal 60 are shaped corresponding to the outer peripheral iron core 20. Furthermore, the number of the iron core coils is preferably a multiple of three, whereby the reactor 6 can be used as a three-phase reactor.

As can be understood from the drawing, the iron core coils 31 to 33 include iron cores 41 to 43, which extend in the radial directions of the outer peripheral iron core 20, and coils 51 to 53 wound onto the iron cores, respectively. The radially outer ends of the iron cores 41 to 43 are in contact with the outer peripheral iron core 20 or are integrally formed with the outer peripheral iron core 20.

Note that, in FIG. 2, the outer peripheral iron core 20 is composed of a plurality, for example, three, outer peripheral iron core portions 24 to 26 divided at equal intervals in the circumferential direction. The outer peripheral iron core portions 24 to 26 are formed integrally with the iron cores 41 to 43, respectively. When the outer peripheral iron core 20 is composed of a plurality of outer peripheral iron core portions 24 to 26, even if the outer peripheral iron core 20 is large, such a large outer peripheral iron core 20 can be easily manufactured. Furthermore, through-holes 29*a* to 29*c* are formed in the outer peripheral iron core portions 24 to 26, respectively.

Further, the radially inner ends of the iron cores 41 to 43 are each located near the center of the outer peripheral iron core 20. In the drawing, the radially inner ends of the iron cores 41 to 43 converge toward the center of the outer peripheral iron core 20, and the tip angles thereof are approximately 120 degrees. The radially inner ends of the iron cores 41 to 43 are separated from each other via gaps 101 to 103, which can be magnetically coupled.

In other words, the radially inner end of the iron core 41 is separated from the radially inner ends of the two adjacent iron cores 42 and 43 via gaps 101 and 103. The same is true for the other iron cores 42 and 43. Note that the sizes of the gaps 101 to 103 are equal to each other.

In the present invention, since a central iron core disposed at the center of the core body 5 is not needed, the core body 5 can be constructed lightly and simply. Further, since the three iron core coils 31 to 33 are surrounded by the outer peripheral iron core 20, the magnetic fields generated by the coils 51 to 53 do not leak to the outside of the outer peripheral core 20. Furthermore, since the gaps 101 to 103 can be provided at any thickness at a low cost, the configuration shown in FIG. 2 is advantageous in terms of design, as compared to conventionally configured reactors.

Further, in the core body 5 of the present invention, the difference in the magnetic path lengths is reduced between the phases, as compared to conventionally configured reactors. Thus, in the present invention, the imbalance in inductance due to a difference in magnetic path length can be reduced.

Referring again to FIG. 1A, leads 51*a* to 53*a* and 51*b* to 53*b* extend from the respective coils 51 to 53. The leads 51*a* to 53*a* are input side leads, and the leads 51*b* to 53*b* are output side leads. The leads 51*a* to 53*a* and 51*b* to 53*b* are individually bent, and as a result, the tips of the leads 51*a* to 53*a* and 51*b* to 53*b* align in rows.

Furthermore, as can be understood from FIG. 1A, an unevenness absorbing member 90 is arranged between the end plate 81 and the core body 5. The unevenness absorbing member 90 absorbs unevenness in the heights of the iron cores 41 to 43 in the axial direction of the core body 5. In other words, the end plate 81 is attached to one end of the core body 5 via the unevenness absorbing member 90. The unevenness absorbing member 90 has substantially the same dimensions as the end plate 81, except for the axial thickness. Furthermore, through-holes 91*a* to 91*c* are formed in the unevenness absorbing member 90 at equal intervals in the circumferential direction. The thickness of the unevenness absorbing member 90 is preferably smaller than the thickness of the end plate 81.

The unevenness absorbing member 90 is formed from a flexible member, such as aluminum, SUS, copper, rubber, a resin or the like. Further, the unevenness absorbing member 90 is preferably formed from a flexible non-magnetic material. Furthermore, the unevenness absorbing member 90 is formed from a material which deforms more easily than the end plate 81. Thus, the magnetic fields can be prevented from passing through the unevenness absorbing member 90.

The end plate 81 and the unevenness absorbing member 90 are annular and comprise openings. As shown in FIG. 1A, one part of the coils 51 to 53 protrudes from the end surface of the core body 5 in the axial direction. By attaching the end plate 81 and the unevenness absorbing member 90 to the core body 5, the protruding portions of the coils 51 to 53 are disposed inside the openings of the unevenness absorbing member 90 and the end plate 81, as shown in FIG. 1B. The upper ends of the protruding portions of the coils 51 to 53 are positioned lower than the upper surface of the end plate 81 and the leads 51*a* to 53*a* and 51*b* to 53*b* protrude above the upper surface of the end plate 81.

Figure 3:
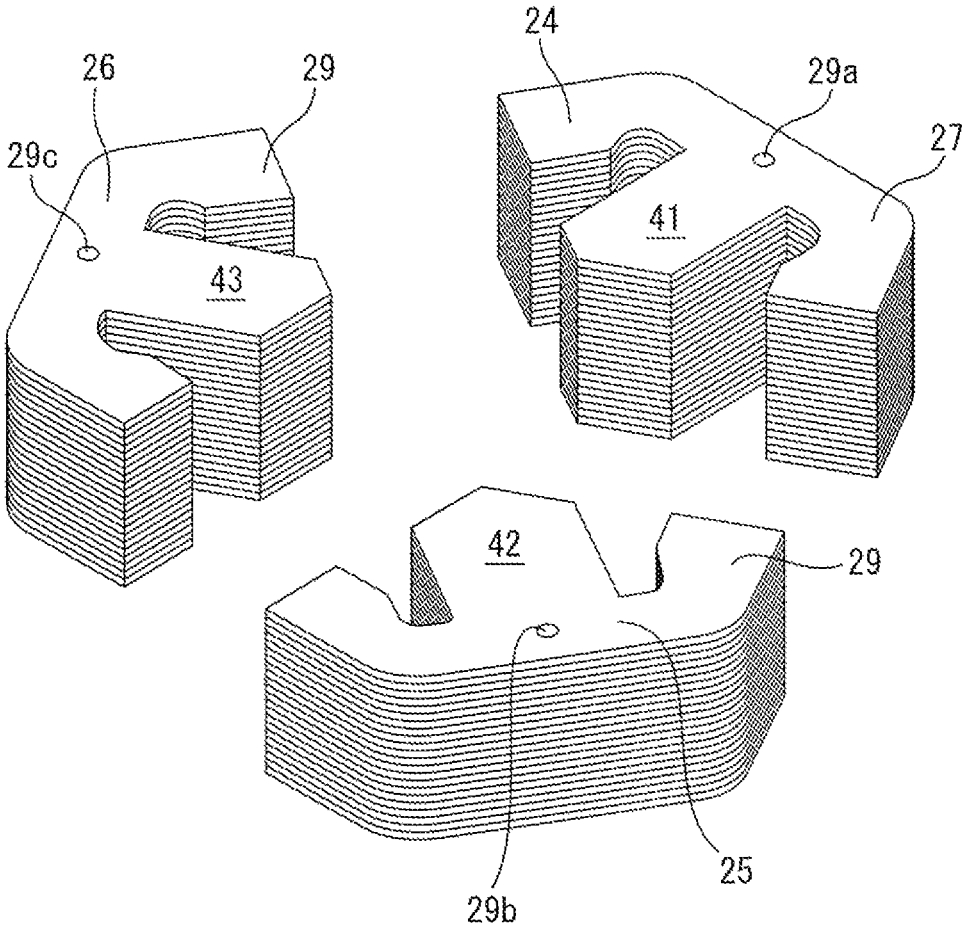
FIG. 3 is a perspective view of conventional iron cores.
Figure 4:
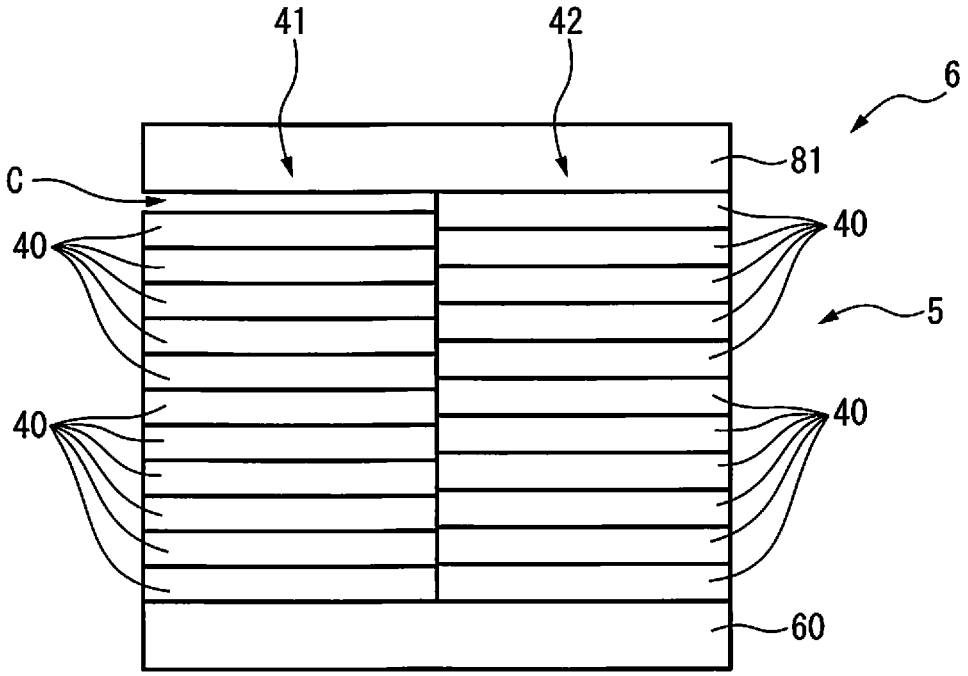
FIG. 4 is an axial sectional view of a reactor.

FIG. 3 is a perspective view of conventional iron cores and FIG. 4 is an axial sectional view of a reactor according to the prior art. Each of the iron cores 41 to 43, which are integral with the outer peripheral iron core portions 24 to 26, is formed by stacking a predetermined number of magnetic plates 40, such as iron plates, carbon steel plates, or electromagnetic steel plates, having the same dimensions. However, strictly speaking, the thicknesses of the plurality of magnetic plates 40 may not be uniform in some cases. Since the predetermined number of the magnetic plates 40 is relatively large, such as several tens of plates or more, when the predetermined number of magnetic plates 40 are stacked, unevenness may occur in the axial heights of the iron cores 41 to 43. The same is true in the present disclosure.

In FIG. 4, the height of the iron core 41 is smaller than the height of the adjacent iron core 42. As a result, a clearance C is formed between the end plate 81 and the uppermost magnetic plate 40 in the region of the iron core 41 but such a clearance C is not formed in the region of the iron core 42. Since such a clearance C is present, there is a problem in that, when the reactor 6 is energized, noise and vibration are generated by the magnetic plates 40 due to magnetostriction.

Figure 5:
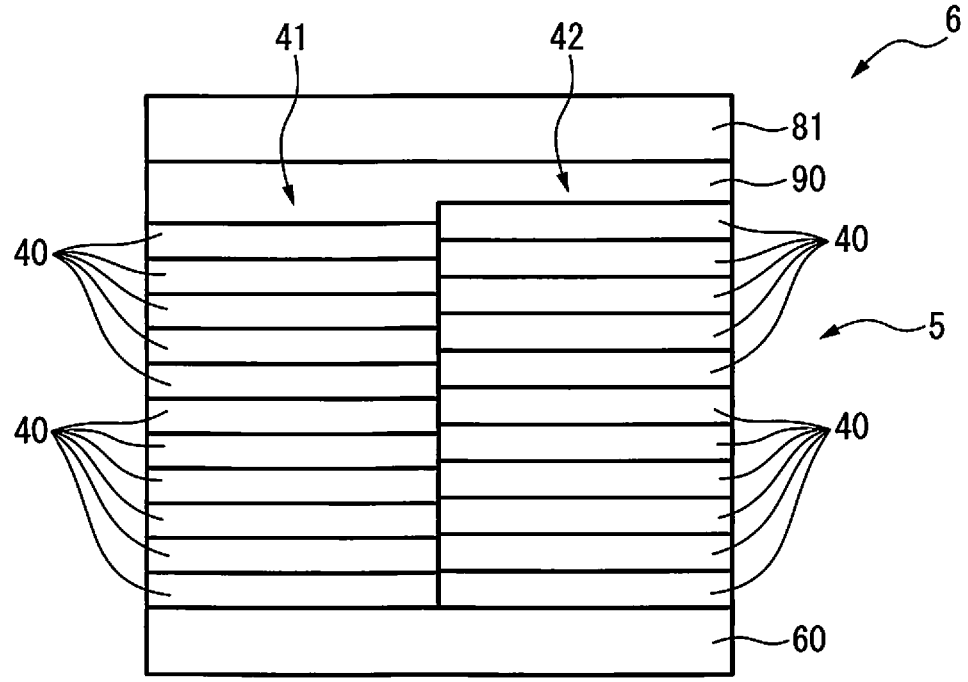
FIG. 5 is an axial sectional view of the reactor shown in FIG. 1B.

Further, FIG. 5 is an axial sectional view of the reactor shown in FIG. 1B. As shown in FIG. 5, in the first embodiment, the flexible unevenness absorbing member 90 is arranged between the end plate 81 and the uppermost magnetic plates 40. By interposing the unevenness absorbing member 90 between the end plate 81 and the uppermost magnetic plates 40, the unevenness absorbing member 90 deforms to fill the clearance C. As a result, the unevenness in the heights of the iron cores 41 to 43 is absorbed. Thus, when the reactor 6 is energized, the generation of noise and vibration by the magnetic plates 40 due to magnetostriction can be prevented.

Further, as can be understood from FIG. 1A, a plurality of shaft parts, for example, screws 99*a* to 99*c*, pass through the through-holes 60*a* to 60*c* of the pedestal 60, the through-holes 29*a* to 29*c* of the core body 5, the through-holes 91*a* to 91*c* of the unevenness absorbing member 90, and the through-holes 81*a* to 81*c* of the end plate 81. The pedestal 60, core body 5, unevenness absorbing member 90 and end plate 81 are preferably engaged with each other by the screws. Thus, since the end plate 81 and the pedestal 60 are drawn toward each other by the plurality of shaft parts, the unevenness absorbing member 90 is further deformed. As a result, it can be understood that the unevenness in the heights of the iron cores 41 to 43 can be further absorbed.

Figure 6:
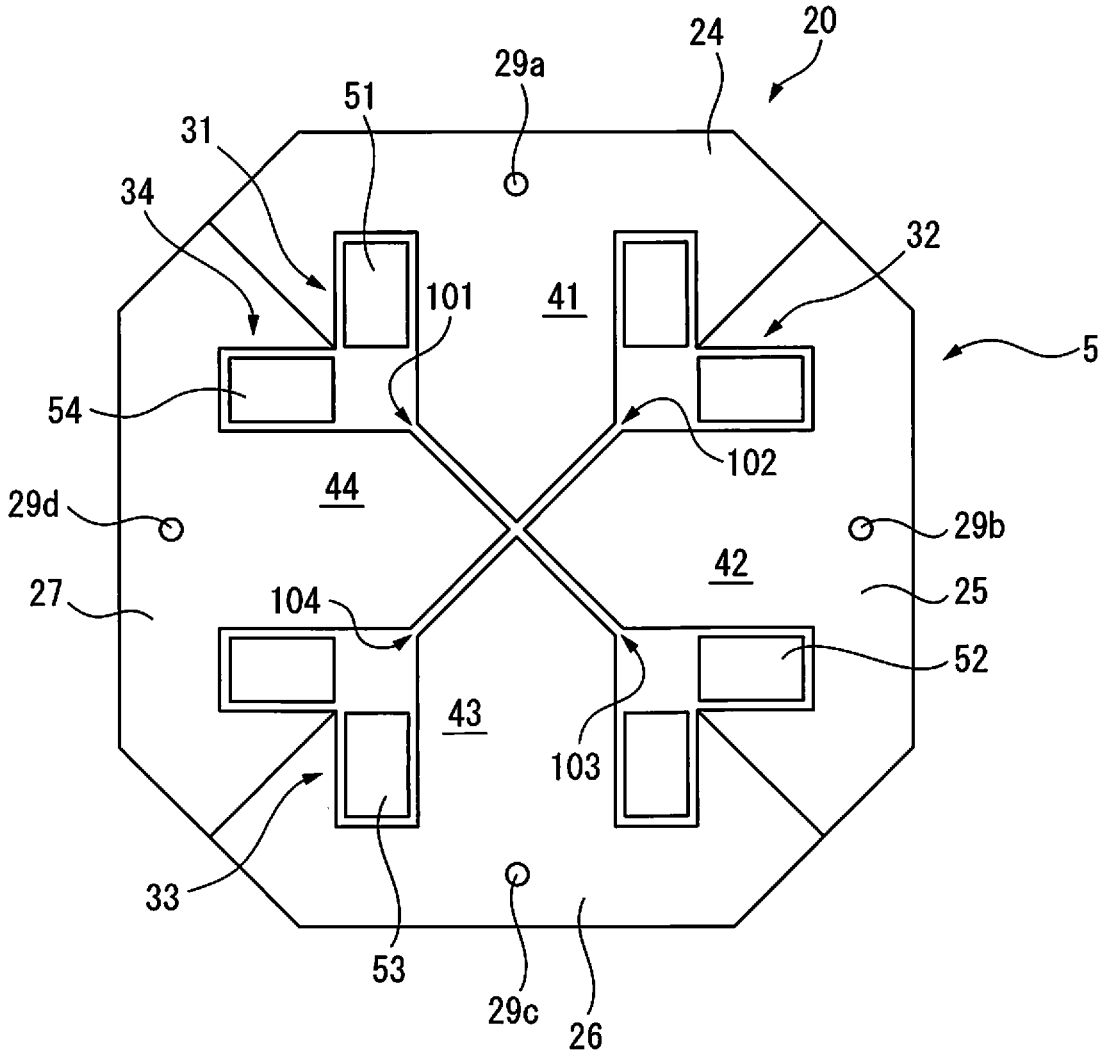
FIG. 6 is a cross-sectional view of the core body of a reactor according to a second embodiment.

FIG. 6 is a cross-sectional view of the core body of a reactor according to a second embodiment. The core body 5 shown in FIG. 6 includes a substantially octagonal outer peripheral iron core 20 and four iron core coils 31 to 34, which are the same as the iron core coils described above, arranged inside the outer peripheral iron core 20. The iron core coils 31 to 34 are arranged at equal intervals in the circumferential direction of the core body 5. Furthermore, the number of the iron cores is preferably an even number not less than four, whereby the reactor including the core body 5 can be used as a single-phase reactor.

As can be understood from the drawing, the outer peripheral iron core 20 is composed of four outer peripheral iron core portions 24 to 27 divided in the circumferential direction. The iron core coils 31 to 34 include iron cores 41 to 44 extending in the radial directions and coils 51 to 54 wound onto the respective iron cores, respectively. The radially outer ends of the iron cores 41 to 44 are integrally formed with the outer peripheral iron core portions 24 to 27, respectively. Note that the number of iron cores 41 to 44 and the number of iron core portions 24 to 27 need not necessarily be the same. The same is true for the core body 5 shown in FIG. 2.

Further, each of the radially inner ends of the iron cores 41 to 44 is located near the center of the outer peripheral iron core 20. In FIG. 6, the radially inner ends of the iron cores 41 to 44 converge toward the center of the outer peripheral iron core 20, and the tip angles thereof are about 90 degrees. The radially inner ends of the iron cores 41 to 44 are separated from each other via the gaps 101 to 104, which can be magnetically coupled.

In the second embodiment, each of the iron cores 41 to 44, which are integrally formed with the respective outer peripheral iron core portions 24 to 27, is formed by stacking the same predetermined number of magnetic plates 40, for example, iron plates, carbon steel plates, or electromagnetic steel plates. Thus, there may be unevenness between in height between the iron cores 41 to 44. In such a case, by similarly arranging an unevenness absorbing member 90 between the end plate 81 and the core body 5, the same effects as described above can be obtained.

Figure 7:
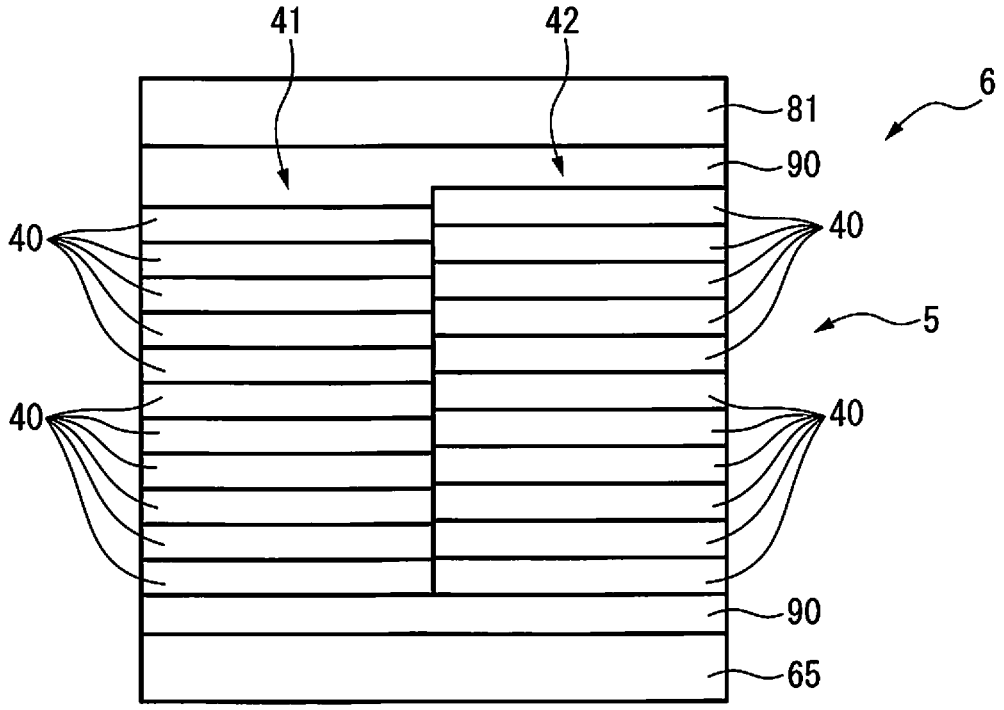
FIG. 7 is an axial sectional view of another reactor.

Further, in the first and second embodiments, a similarly formed additional unevenness absorbing member 90 may be similarly arranged between the core body 5 and the pedestal 60. Alternatively, as shown in FIG. 7, unevenness absorbing members 90 may be arranged both between the core body 5 and the pedestal 60 and between the end plate 81 and the core body 5. Further, the outer peripheral iron core 20 may not be composed of a plurality of outer peripheral iron core portions 24 to 26 (27), and the iron cores 41 to 43 (44) may be in contact with the inner surface of the outer peripheral iron core 20. Such a case is included in the scope of the present disclosure.

ASPECTS OF THE DISCLOSURE

According to a first aspect, there is provided a reactor (6) comprising a core body (5) including at least three iron cores (41 to 44) composed of a plurality of stacked magnetic plates (40), wherein gaps (101 to 104) are formed between one of the at least three iron cores and another iron core adjacent thereto, through which gaps the iron cores are magnetically connectable, the reactor further comprising an end plate (81) and a pedestal (60) which are coupled to the core body so as to interpose the core body therebetween, and an unevenness absorbing member (90) arranged at least one of a region between the end plate and the core body and a region between the core body and the pedestal, for absorbing unevenness in heights of the at least three iron cores in an axial direction of the core body.

According to the second aspect, in the first aspect, the core body includes an outer peripheral iron core (20) composed of a plurality of outer peripheral iron core portions (24 to 27), the at least three iron cores are coupled to the plurality of outer peripheral iron core portions, and coils (51 to 54) are wound onto the at least three iron cores.

According to the third aspect, in the first or second aspect, the unevenness absorbing member is made of a flexible material.

According to the fourth aspect, in any of the first through third aspects, further comprising a plurality of shaft parts (99*a* to 99*c*) which are arranged in the vicinity of the outer edge of the core body, and which are supported by the end plate and the pedestal.

According to the fifth aspect, in any of the first through fourth aspects, the number of the at least three iron cores is a multiple of three.

According to the sixth aspect, in any of the first through fourth aspects, the number of the at least three iron cores is an even number not less than 4.

EFFECTS OF THE ASPECTS

In the first aspect, since an unevenness absorbing member is arranged, unevenness in the heights of the iron cores can be absorbed. Thus, clearances between the end plate and the core body and between the core body and the pedestal can be eliminated, whereby, at the time of energization, noise and vibration caused by magnetostriction can be suppressed.

In the second aspect, since the coils are surrounded by the outer peripheral iron core, leakage of magnetic flux can be prevented.

In the third aspect, unevenness in the heights of the iron cores can be appropriately absorbed. The flexible material is aluminum, copper, rubber, or a resin material.

In the fourth aspect, since the end plate and the pedestal are drawn toward each other by the plurality of shaft parts, unevenness in the heights of the iron cores can be further absorbed.

In the fifth aspect, the reactor can be used as a three-phase reactor.

In the sixth aspect, the reactor can be used as a single-phase reactor.

Though the present invention has been described using representative embodiments, a person skilled in the art would understand that the foregoing modifications and various other modifications, omissions, and additions can be made without departing from the scope of the present invention.

The invention claimed is:

1. A reactor comprising a core body including at least three iron cores composed of a plurality of stacked magnetic plates, wherein the core body includes an outer peripheral iron core composed of a plurality of outer peripheral iron core portions, the at least three iron cores are connected to the plurality of outer peripheral iron core portions, coils are wound around the at least three iron cores, and gaps are formed between one of the at least three iron cores and another iron core adjacent thereto, through which gaps the iron cores are magnetically connectable, the reactor further comprising:

an end plate and a pedestal which are coupled to the core body so as to interpose the core body therebetween, and an unevenness absorbing member arranged in at least one of a region between the end plate and the at least three iron cores of the core body and a region between the at least three iron cores of the core body and the pedestal, for absorbing unevenness in heights of the at least three iron cores in an axial direction of the core body.

2. The reactor according to claim 1, wherein the unevenness absorbing member is made of a flexible material.

3. The reactor according to claim 1, further comprising a plurality of shaft parts which are arranged in the vicinity of an outer edge of the core body, and which are supported by the end plate and the pedestal.

4. The reactor according to claim 1, wherein the number of the at least three iron cores is a multiple of three.

5. The reactor according to claim 1, wherein the number of the at least three iron cores is an even number not less than 4.

6. A reactor comprising a core body including at least three iron cores composed of a plurality of stacked magnetic plates, wherein the core body includes an outer peripheral iron core composed of a plurality of outer peripheral iron core portions, the at least three iron cores are connected to the plurality of outer peripheral iron core portions, coils are wound around the at least three iron cores, and gaps are formed between one of the at least three iron cores and another iron core adjacent thereto, through which gaps the iron cores are magnetically connectable, the reactor further comprising:

an end plate and a pedestal which are coupled to the core body so as to interpose the core body therebetween, and an unevenness absorbing member arranged in at least one of a region between the end plate and the core body and a region between the core body and the pedestal, for absorbing unevenness in heights of the at least three iron cores in an axial direction of the core body, and wherein the number of the at least three iron cores is a multiple of three.

7. The reactor according to claim 6, wherein the unevenness absorbing member is made of a flexible material.

8. The reactor according to claim 6, further comprising a plurality of shaft parts which are arranged in the vicinity of an outer edge of the core body, and which are supported by the end plate and the pedestal.

9. A reactor comprising a core body including at least three iron cores composed of a plurality of stacked magnetic plates, wherein gaps are formed between one of the at least three iron cores and another iron core adjacent thereto, through which gaps the iron cores are magnetically connectable, the reactor further comprising:

an end plate and a pedestal which are coupled to the core body so as to interpose the core body therebetween, and an unevenness absorbing member arranged in at least one of a region between the end plate and the core body and a region between the core body and the pedestal, for absorbing unevenness in heights of the at least three iron cores in an axial direction of the core body, and wherein the number of the at least three iron cores is an even number not less than 4.

10. The reactor according to claim 9, wherein the core body includes an outer peripheral iron core composed of a plurality of outer peripheral iron core portions, the at least three iron cores are connected to the plurality of outer peripheral iron core portions, and coils are wound around the at least three iron cores.

11. The reactor according to claim 9, wherein the unevenness absorbing member is made of a flexible material.

12. The reactor according to claim 9, further comprising a plurality of shaft parts which are arranged in the vicinity of an outer edge of the core body, and which are supported by the end plate and the pedestal.

* * * * *